US007291060B2

(12) United States Patent
Yan et al.

(10) Patent No.: US 7,291,060 B2
(45) Date of Patent: Nov. 6, 2007

(54) APPARATUS FOR SCREW-POLISHING WITH ABRASIVE AND METHOD THEREOF

(75) Inventors: Biing-Hwa Yan, Jhongli (TW); Hsinn-Jyh Tzeng, Taipei (TW)

(73) Assignee: National Central University, Taoyuan (TW)

( * ) Notice: Subject to any disclaimer, the term of this patent is extended or adjusted under 35 U.S.C. 154(b) by 0 days.

(21) Appl. No.: 11/293,202

(22) Filed: Dec. 5, 2005

(65) Prior Publication Data

US 2007/0049174 A1 Mar. 1, 2007

(30) Foreign Application Priority Data

Aug. 31, 2005 (TW) ..... 94129948 A

(51) Int. Cl.
*B24B 31/00* (2006.01)

(52) U.S. Cl. ..... 451/113; 451/61

(58) Field of Classification Search ..... 451/104, 451/113, 61, 327, 328, 329, 326, 27
See application file for complete search history.

(56) References Cited

FOREIGN PATENT DOCUMENTS

| | | | | |
|---|---|---|---|---|
| JP | 55-83560 | * | 6/1980 | ..... 451/104 |
| JP | 59-156662 | * | 9/1984 | ..... 451/113 |
| SU | 000831572 | * | 5/1981 | ..... 451/113 |
| SU | 001328167 | * | 8/1987 | ..... 451/113 |

* cited by examiner

*Primary Examiner*—Robert A. Rose
(74) *Attorney, Agent, or Firm*—Troxell Law Office, PLLC

(57) ABSTRACT

The present invention is applied in the fields of precise transmission devices, bio-medical devices and military-use devices to polish a surface of an object by an abrasive carried by the rotating of a screw.

6 Claims, 12 Drawing Sheets

APPARATUS FOR SCREW-POLISHING WITH ABRASIVE AND METHOD THEREOF

FIELD OF THE INVENTION

The present invention relates to screw-polishing; more particularly, relates to carrying an abrasive by a screw for fast removing burrs, pieces and a deteriorated exterior to obtain a fine-polished surface.

DESCRIPTION OF THE RELATED ARTS

Nowadays, a micro channel, a bio-chip, a 3C optical guide board, etc. require productions obtaining light-weight, smallness, fineness and size minimized. Related researches are popular and have become top hits in the fields of micro-machine, precise screw, industries of aviation and space, vehicle transmission and bio-medicine.

Take the applications in the military for example. The production and refinement for the precise screwed rifling in a barrel requires a good method for removing burrs precisely. Yet, until now, no satisfying solution is provided; not to mention the more complex refinement for an inner or outer screwing thread.

A prior art is proclaimed in a Japanese patent, 2002 by Hitoshi Ohmori, etc., which discloses an abrasive chip of metal free, a polishing method using an electrolysis, and an apparatus for the polishing method. By using a connecting part between the abrasive and a carbon-containing non-metallic material containing the abrasive, a polishing of good efficiency is obtained with the help of the electrolysis. The prior art refines the roughness of the outer surface; yet, its applications to an inner or outer screwing thread or an irregular curved surface still has rooms left for improvement. In 2004, another prior art is disclosed by V. K. Gorana, etc. in International Journal of Machine Tool & Manufacture, Vol. 44, pp. 201-211, which discusses the effect of the extrusion pressure, the abrasive density and the diameter of the particle to the material removing amount, the surface roughness, the cutting force and the density of the actuated particles by polishing with a flowing abrasive. Parameters for the polishing discussed includes: particle diameter, abrasive type, concentration rate of a mixture, polishing time, and the material of the to-be-polished object. The polishing method for the prior art is to remove material and to refine surface by a reciprocating motion with pressure to the to-be-polished object, where its application is especially focused on precise transmission device. And, the disadvantage still remains that applications to an inner or outer screwing thread or an irregular curved surface still has rooms left for improvement. A third prior art is disclosed in 2004 by V. K. Jain, etc. in the International Journal of Machine Tool & Manufacture, Vol. 44, pp. 1019-1029, which designs a polishing method having a combination of a polishing with particles and a fine polishing with an electromagnetic flow. A research on the surface roughness and the removal amount of the material after using the method with various abrasives is studied. Furthermore, a method for polishing with rotating particles driven by rotating magnetic poles is developed; and a research on the shapes of the magnetic poles and their rotating velocities are studied with regard to the surface roughness and the removal amount of the material after the polishing. Likewise, the disadvantage remains that applications to an inner or outer screwing thread or an irregular curved surface still has rooms left for improvement on material removing and surface refining.

In a word, although the above prior arts can improve the surface fineness of the to-be-polished object, the disadvantage regarding removing burrs, pieces and deteriorated exterior in an inner or outer tiny screw slot or on an irregular surface is still left unsolved. Hence, the prior arts do not fulfill users' requests on actual use.

SUMMARY OF THE INVENTION

The main purpose of the present invention is to rapidly remove burrs, pieces and a deteriorated exterior to obtain a fine-polished surface.

To achieve the above purpose, the present invention is an apparatus for screw-polishing with abrasive and a method thereof, where the apparatus, comprised of a main shaft, a screw, at least one clip, and an abrasive, polishes a surface of a to-be-polished object with the abrasive carried by a rotating of the screw for rapidly removing burrs, pieces and a deteriorated exterior; and the clip comprises a center aperture surrounded by at least one surrounding aperture for a circular flow of the abrasive. Accordingly, a novel apparatus for screw-polishing with abrasive and a method thereof are obtained.

BRIEF DESCRIPTIONS OF THE DRAWINGS

The present invention will be better understood from the following detailed descriptions of the preferred embodiments according to the present invention, taken in conjunction with the accompanying drawings, in which FIG. 1 is a perspective view showing a first preferred embodiment according to the present invention;

DESCRIPTION OF THE PREFERRED EMBODIMENTS

The following descriptions of the preferred embodiments are provided to understand the features and the structures of the present invention.

Figure 1:
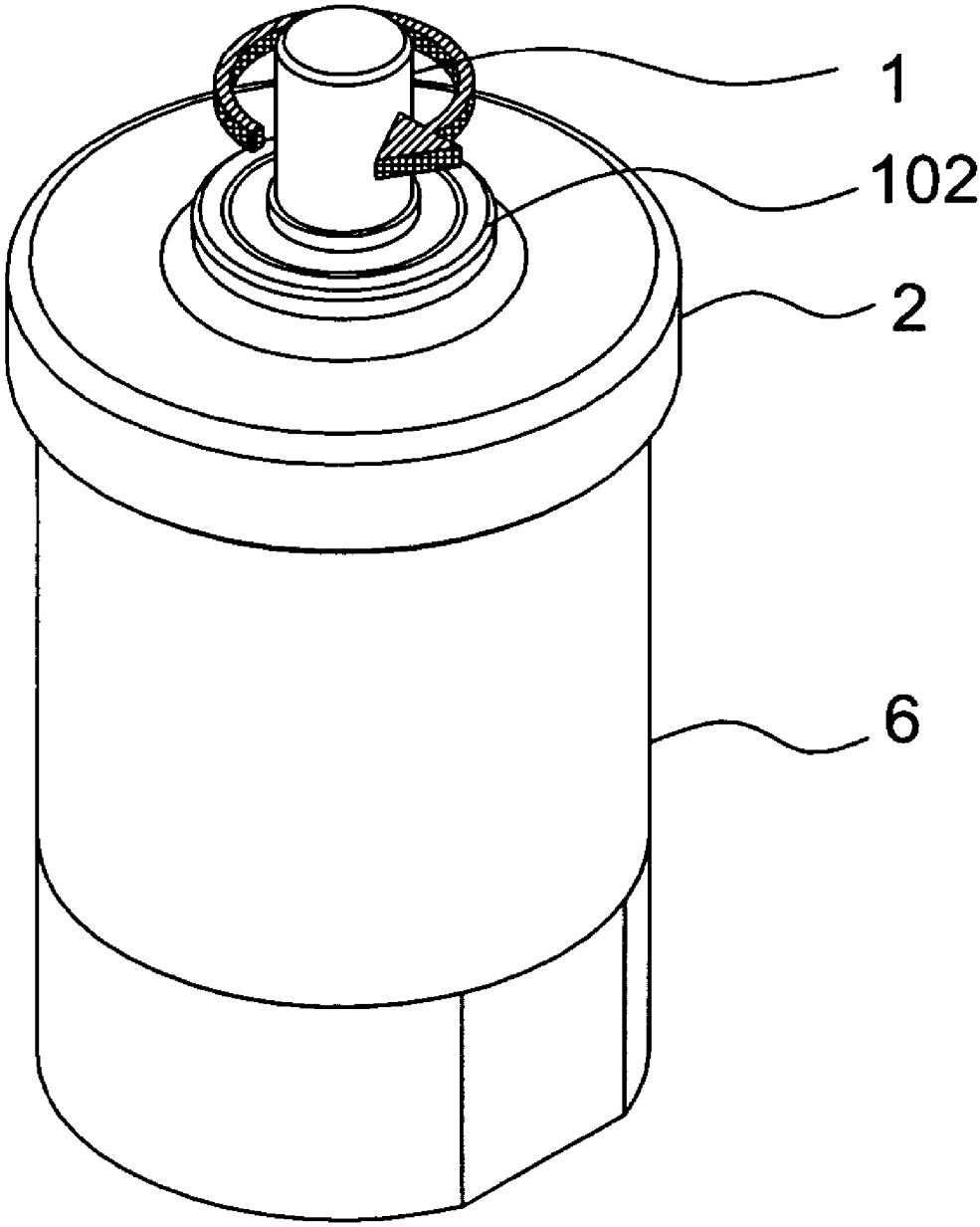
Figure 2:
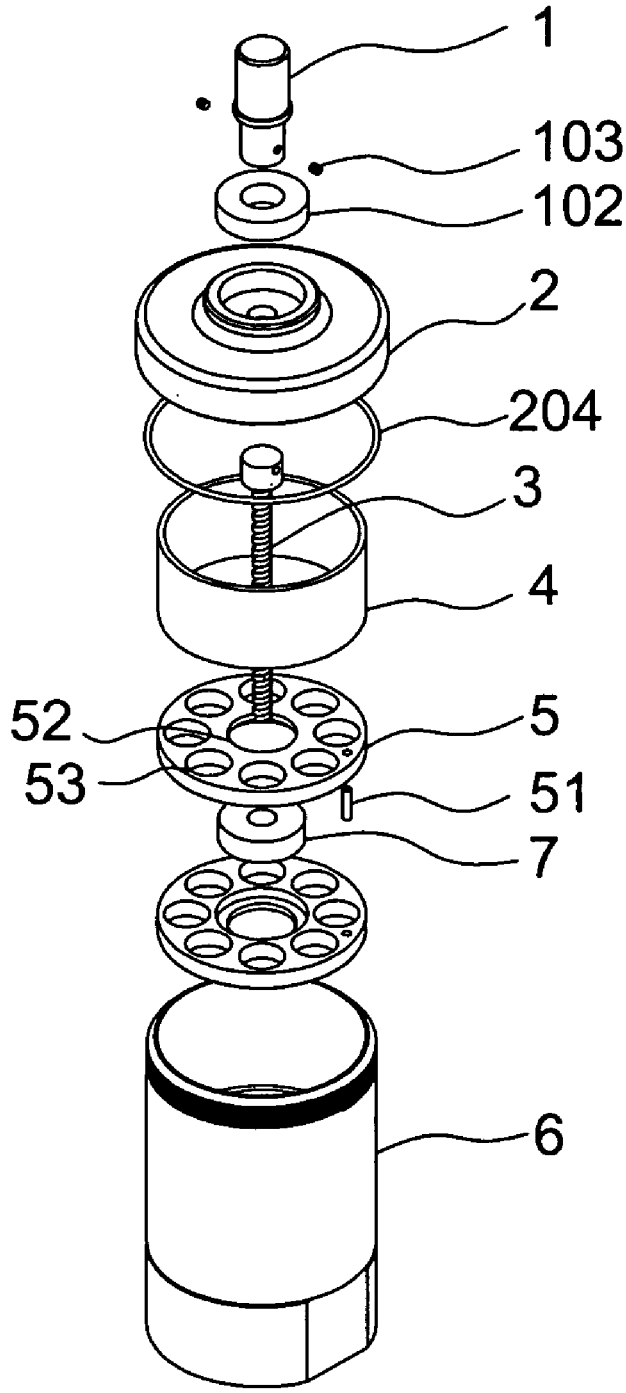
FIG. 2 is an explosive structure view showing the first preferred embodiment according to the present invention.
Figure 3:
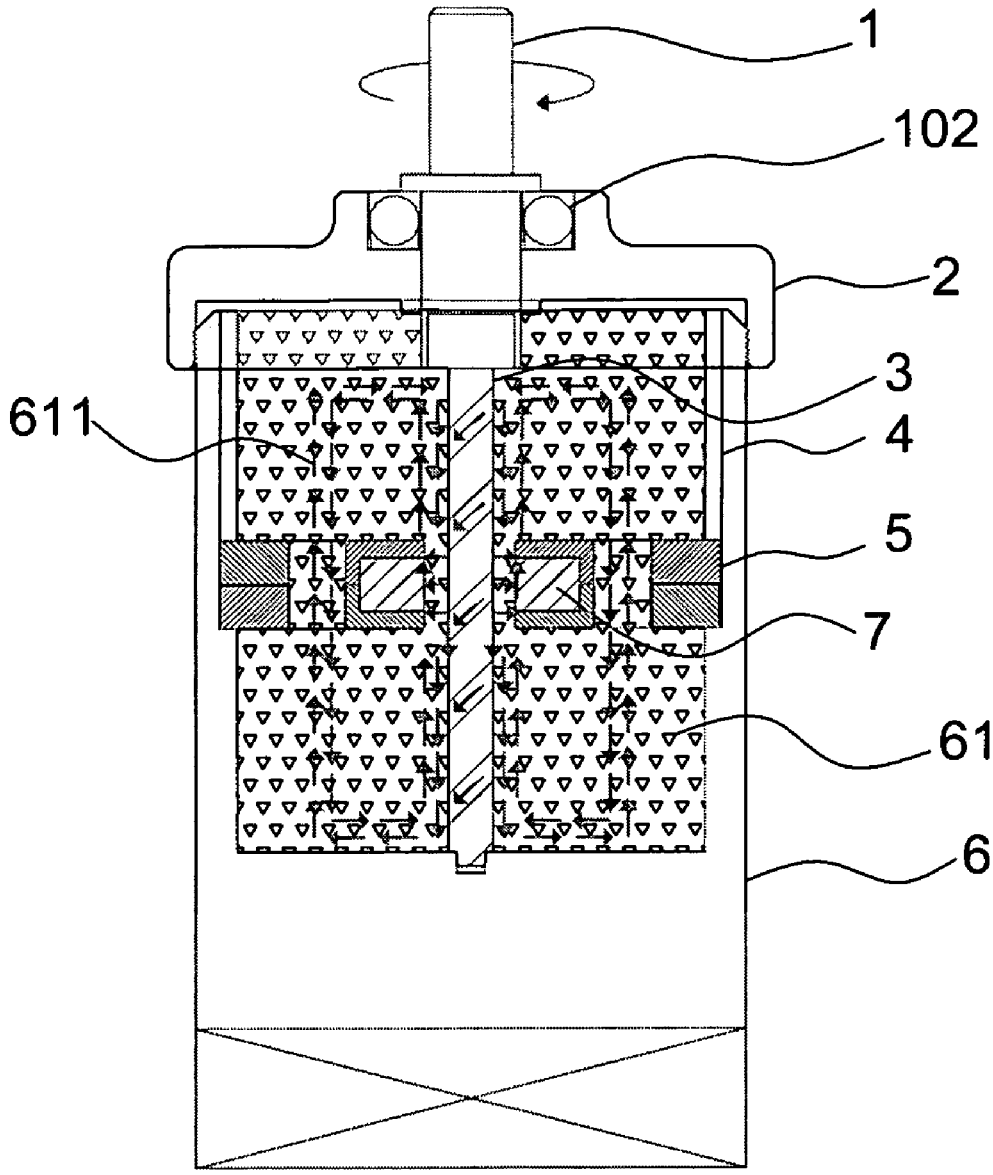
FIG. 3 is a cross-sectional view showing the first preferred embodiment according to the present invention.

Please refer to FIG. 1 through FIG. 3, which are a perspective view, an explosive structural view and a cross-sectional view showing a first preferred embodiment according to the present invention. The present invention is an apparatus for screw-polishing with abrasive and a method thereof, where an abrasive 61 is carried by a screw 3 and a surface of a to-be-polished object 7 is polished by particles contained in the abrasive 61. As shown in the figures, the present invention comprises a main shaft 1, a cover 2, a screw 3, a pressing bushing 4, at least one clip 5 and a main body 6, which is used in the fine-polishing process of a screwed rifling of a military-use barrel aperture.

The main shaft 1 is connected to a rotating spindle of a processing station (not shown in the figures) at an end; and a screw 3 is connected with the main shaft 1 at another end to be locked with a fixing key (a bolt) 103. The screw 3 reaches into the main body 6 through the cover 2, which comprises a diameter size, a screwing angle and a screw-slotting size according to the characteristics of the fine-polishing process. The angle of the screw 3 can be a changeable one.

The cover 2 is tightly assembled to the main shaft 1 with a ball bearing 102, a roller bearing or a needle bearing in between; the cover 2 can further comprise a straight-line moving bearing for a straight-line reciprocating motion by the main shaft; and, so, a fine polishing is obtained with the bearings. The cover 2 presses a pressing bushing 4 with a tightening cushion 204 in between so that the cover 2 is totally tightened with the main body 6, where the tightening cushion 204 is of good elasticity and tightening capability, such as an O-ring.

The clip 5 clips the to-be-polished object, coordinated with the pressing bushing 4. A center aperture 52 is located at center of the clip 5, through which the screw 3 reaches into the to-be-polished object 7. At least one surrounding aperture 53 is located around the center aperture 52 so that the abrasive 61 flows circularly through the apertures 52, 53. The size, shape and arrangement of the surrounding aperture 53 are adjusted to be coordinated with the to-be-polished object and so as to assure a smooth circular-flowing 611 of the abrasive 61. The clip 5 is locked with a fixing key (a bolt) 51, whose number is determined according to the capacity of the main body 6 so that a number of to-be-polished objects 7 can be polished at a time. Thus, a novel apparatus for screw-polishing with abrasive and a method thereof are obtained.

The apparatus for screw-polishing with abrasive according to the present invention comprises a method, which comprises the following steps:

(a) The to-be-polished object 7 is clipped in the clip 5 to be fixed in the main body 6 with the pressing bushing 4, where the main body 6 is loaded with the abrasive 61. Then, the screw 3 reaches into the main body 6 through the to-be-polished object 7; and the cover 2 is tightened to the main body 6.

(b) The main shaft 1 is fixed by revolving to a rotating spindle of a processing station (not shown in the figures); and the bottom of the main body 6 is fixed to the processing station.

(c) Parameters of types of the abrasive 61 and the screw 3 and a parameter of a rotational velocity of the screw 3 are set.

(d) While the main shaft 1 is driven by the processing station, the abrasive is carried by the screw 3 following a reciprocating motion of the main shaft 1 along with a rotating motion of the screw 3 to polish the to-be-polished object 7.

(e) And, in the end, the processing station is turned off to stop the polishing and the to-be-polished object 7 is taken out.

Figure 4:
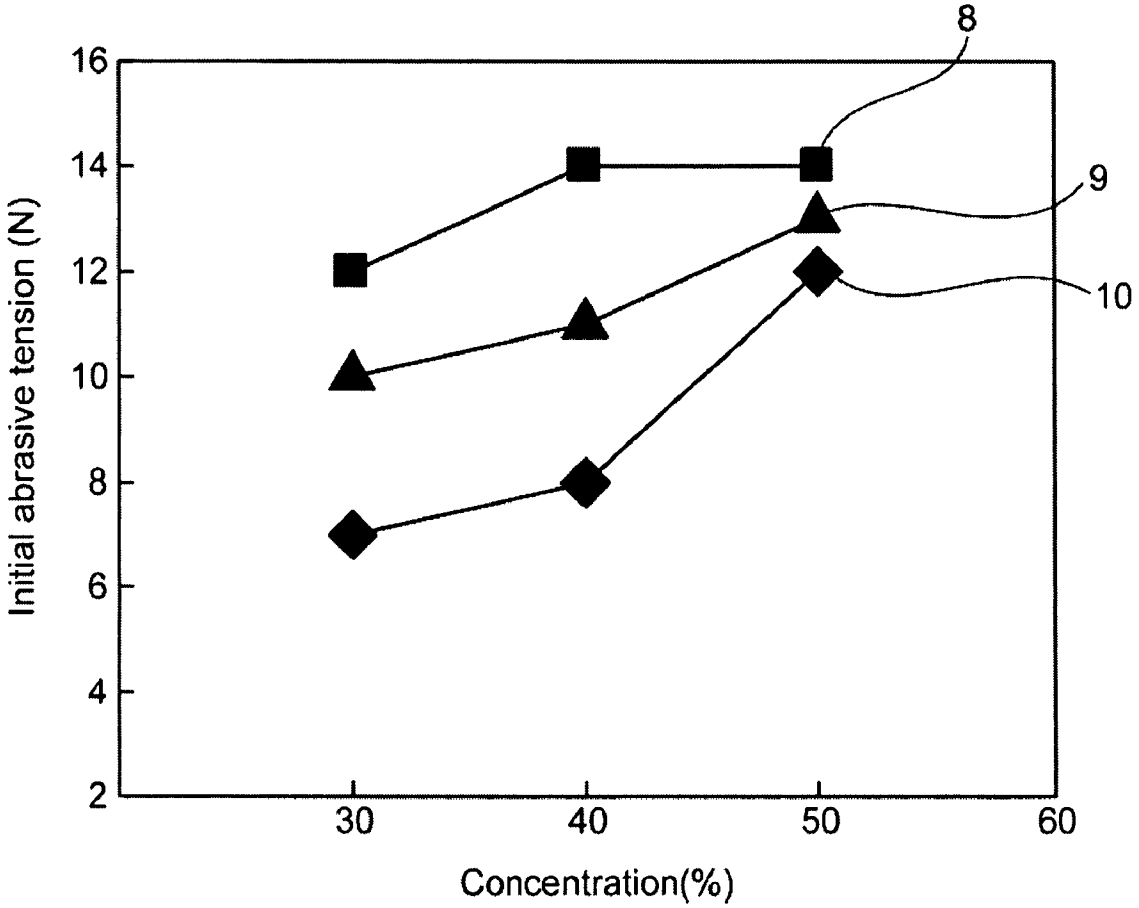
FIG. 4 is a view showing relationships between viscosities and particle diameters of initial abrasives according to the present invention.
Figure 10:
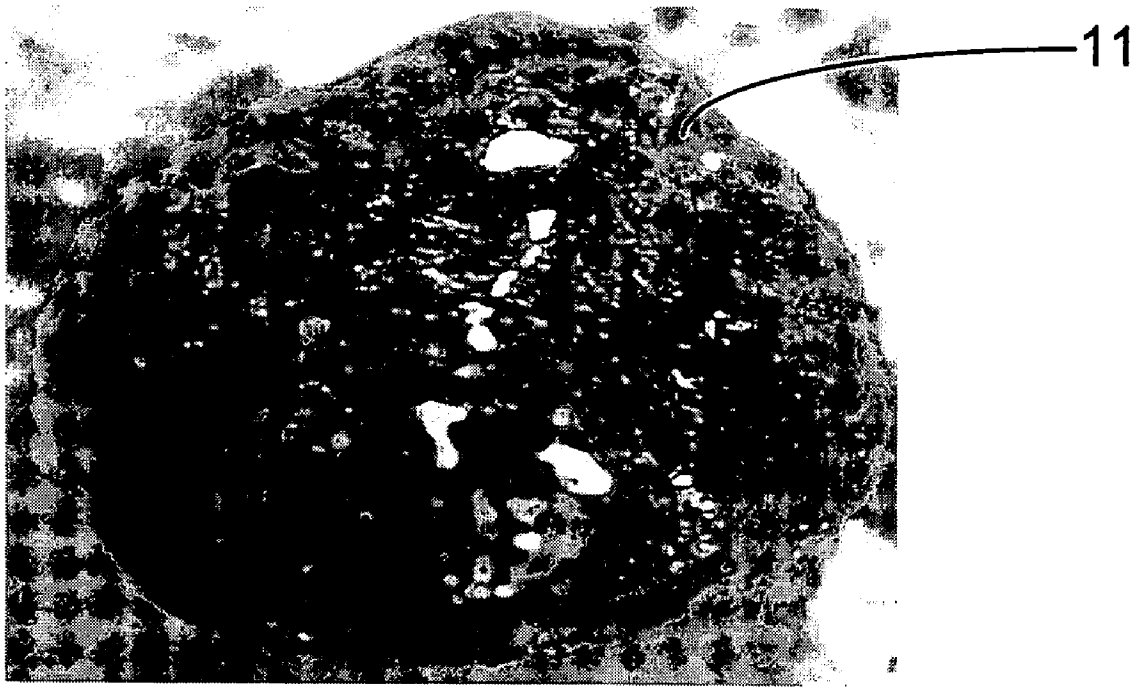
FIG. 10 is a view showing an appearance of an initial abrasive according to the present invention.

Please refer to FIG. 4 and FIG. 10, which are views showing relationships between viscosities and particle diameters of initial abrasives and an appearance of an initial abrasive according to the present invention. The abrasive 11 is made of an ester of a silicon oil, a wax oil or a polymer gel mixed with a silicon carbide (SiC) of a various particle diameter to obtain a gel shape, as shown in FIG. 10, having high viscosity and adhesive elasticity helpful to lubricating, refining and removing. As shown in FIG. 4, abrasives 8, 9, 10 are manufactured, including an abrasive 8 containing particles of 150 μm (micrometer) diameter, another abrasive 9 containing particles of 30 μm diameter and the other abrasive 10 containing particles of 12 μm diameter; and are made for polishing a to-be-polished object (not shown in the figures) under various concentrations of the abrasives 8, 9, 10 as 30%, 40% and 50%. The abrasives 8, 9, 10 are of high adhesive elasticity out of polymer structure, which has characteristics of strong bonds and good condense within. Yet, these characteristics will be changed to obtain a certain fluid form according to the processing time and the rotational velocity of screw. When an abrasive 8, 9, 10 is stirred at a high rotational velocity by a screw (not shown in the figure), a relative motion happens between the particles in the abrasive 8, 9, 10 during the process. Following the speeding-up of the rotational velocity of the screw, the supply speed of the abrasive 8, 9, 10 fluid is speeded up too. Hence, tiny refinements are obtained for polishing a surface of the to-be-polished object. As the polishing time passes by, the viscosity of the abrasive 8, 9, 10 is reduced obviously so that an abrasive fluid 8, 9, 10 with good fluidity is obtained because of damages to the bonds out of the rotating within the polymer abrasive 8, 9, 10. Even though the material removal of the to-be-polished object is slowed down at the time, the fluid form of the abrasive 8, 9, 10 benefits micro-refining ability on obtaining a better surface by greatly refining the roughness of the to-be-polished object. Moreover, an abrasive according to the present invention can be used in polishing surfaces of various materials, where even a non-adhesive abrasive can be manually made according to processing requirements. That is to say, when polishing a to-be-polished object, a specific abrasive for the polishing can be obtained as a medium or a carrier to extrude on the surface while stirring the screw.

Figure 5A:
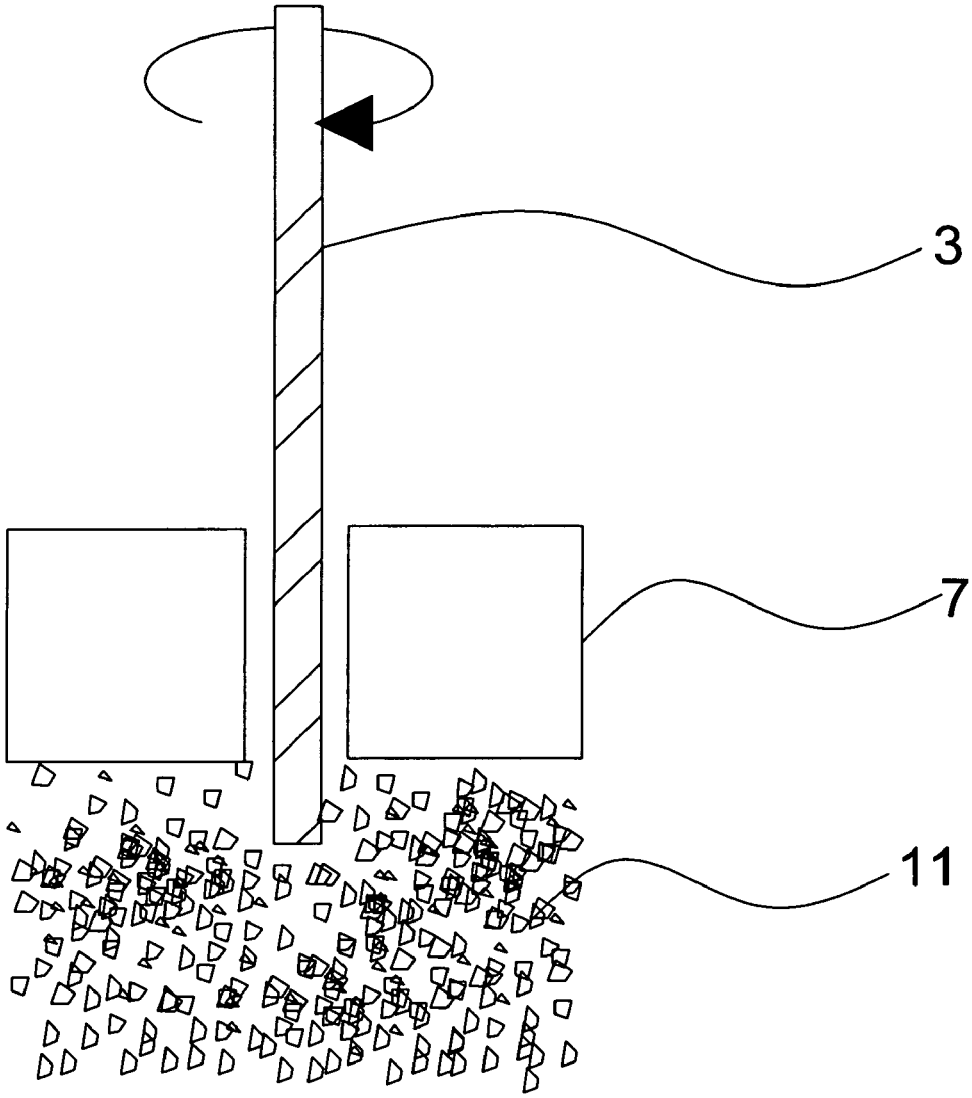
FIG. 5A and FIG. 5B are views showing statuses of abrasives before and during polishing according to the present invention.
Figure 5B:
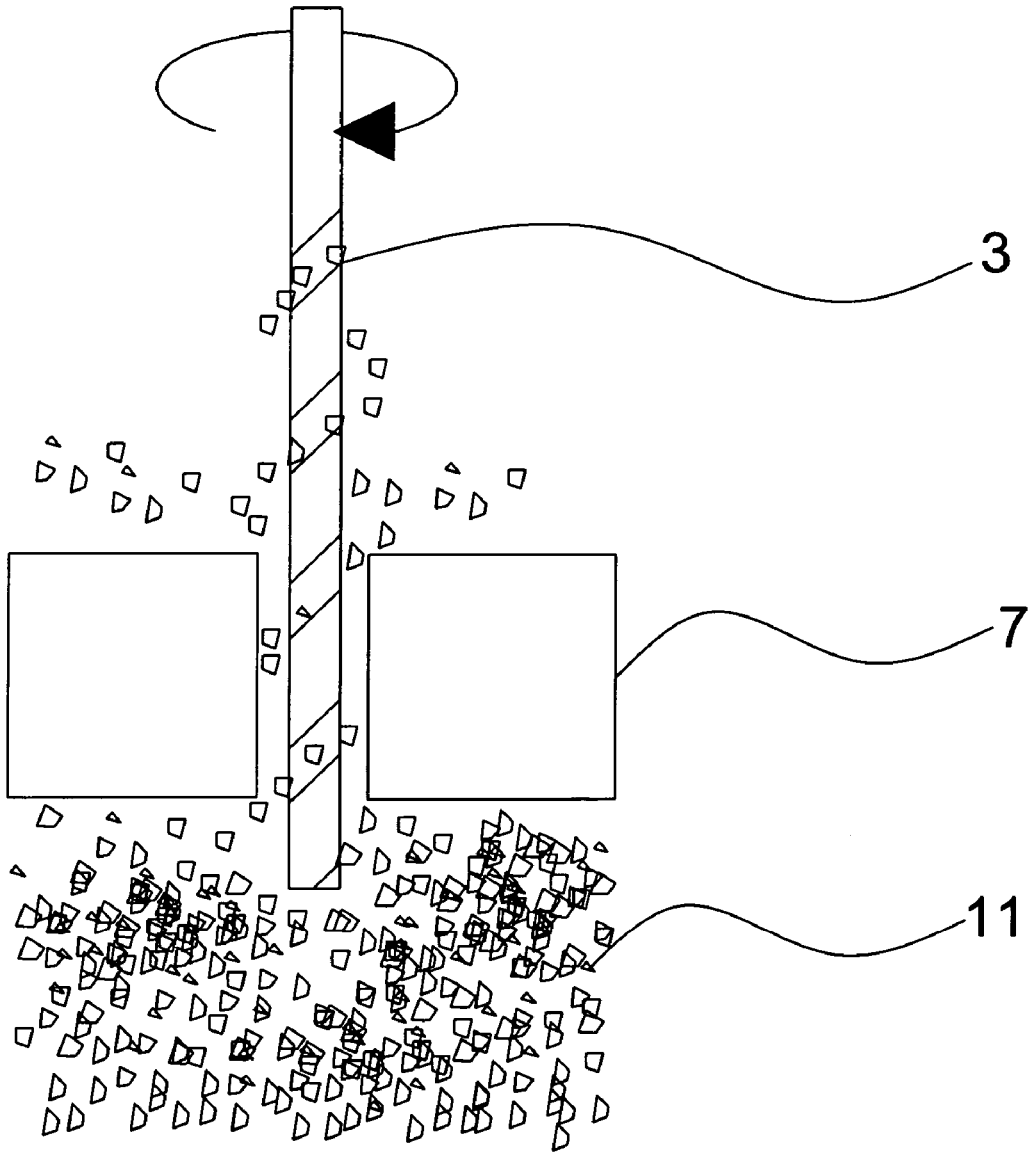

Please refer to FIG. 5A and FIG. 5B, which are views showing statuses of abrasives before and during polishing according to the present invention. As shown in the figures, an abrasive 11 is carried out smoothly by the stirring of the screw 3, where the abrasive 11 obtains good fluidity after a period of stirring of the screw 3. With well-mixed polymer particles in the abrasive 11, interferences among the particles are obtained owing to a relative motion of extruding occurred on stirring the screw 3; and the space between the screw 3 and a to-be-polished object 7 is ever-changing owing to a narrowing-down of the diameter of the screw 3 so that effective polishing force together with removing force is obtained by directly in touch with the surface of the to-be-polished object 7. Then, following the speeding-up of the rotational velocity of the screw 3, the removing ability of the abrasive 11 is increased; likewise, the supply speed of the abrasive 11 is faster as well. As a result, tiny refinements are obtained for polishing the surface of the to-be-polished object.

Figure 6A:
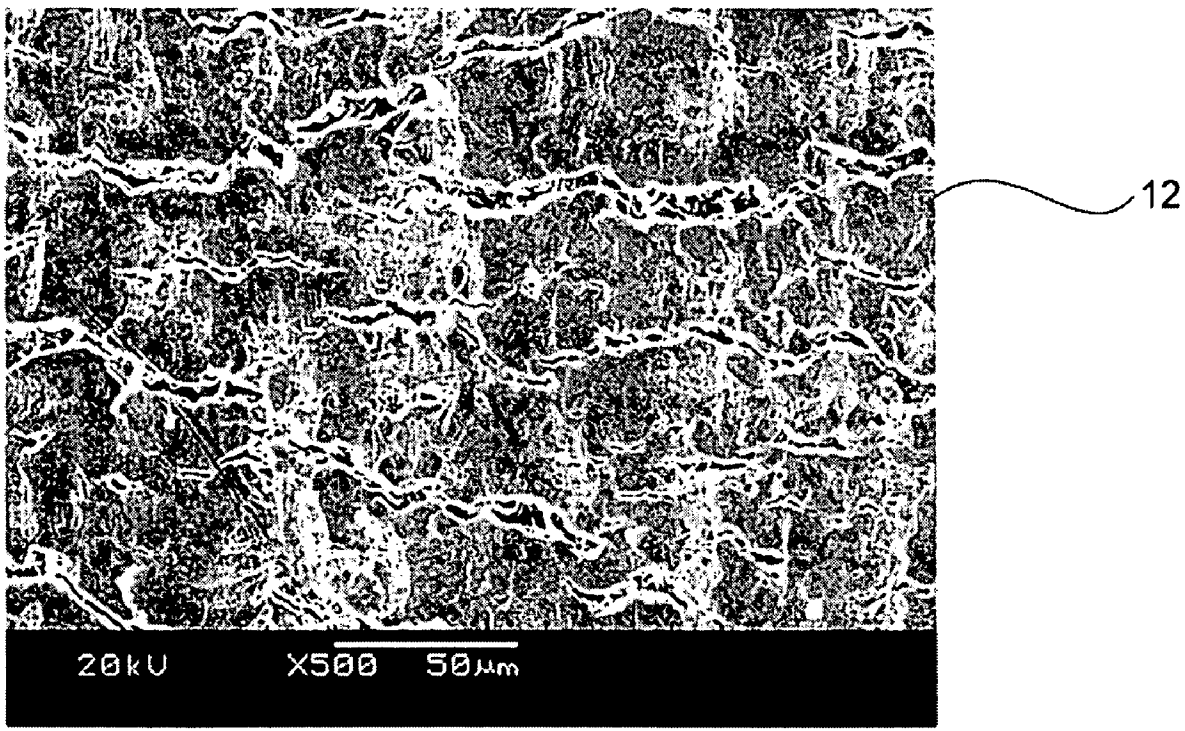
FIG. 6A and FIG. 6B are SEM (scanning electron microscope) views showing surfaces of a to-be-polished object before and after polishing according to the present invention.
Figure 6B:
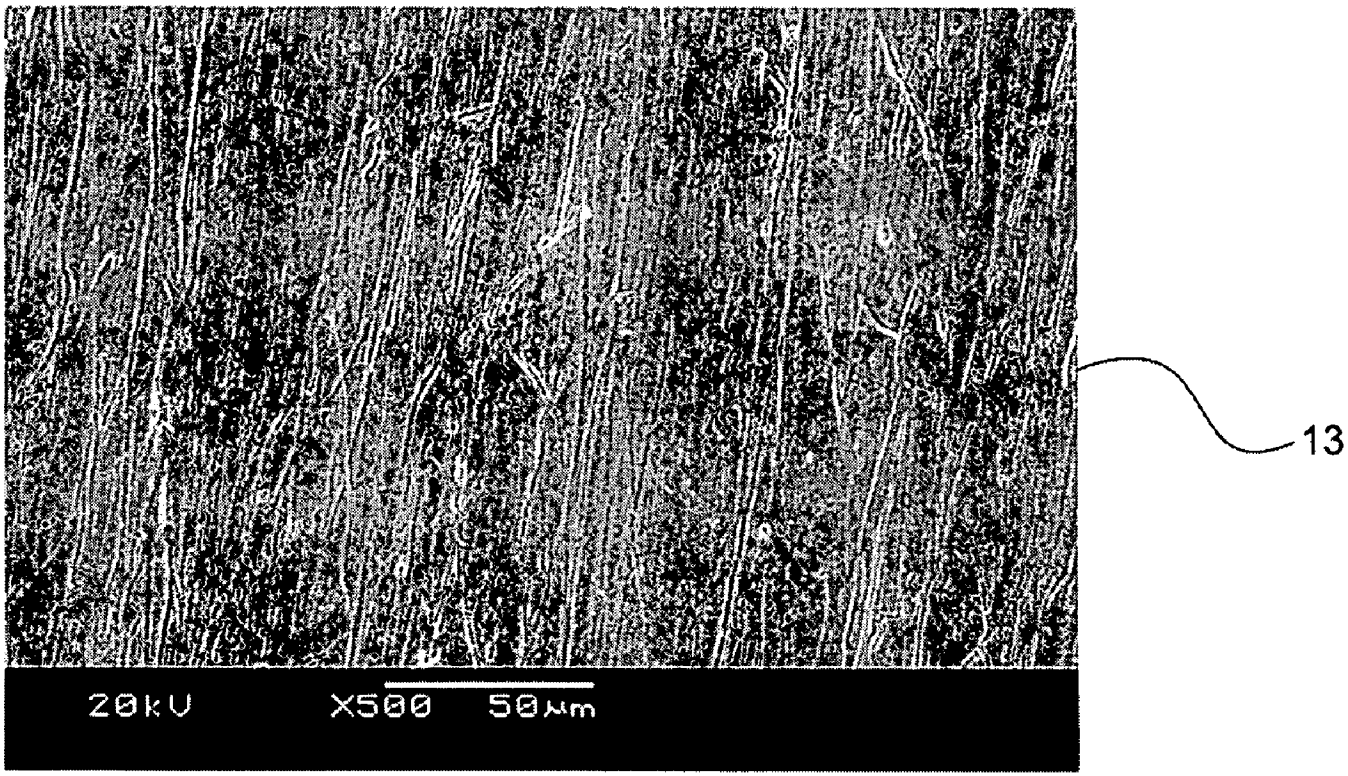

Please refer to FIG. 6A and FIG. 6B, which are SEM views showing surfaces of a to-be-polished object before and after polishing according to the present invention. As shown in the figures, a surface of a to-be-polished object is polished with a screw and an abrasive according to the present invention. Therein, the screw comprises a diameter of 5 mm (millimeter) and a rotational velocity of 800 rpm (revolution per minute); and the abrasive comprises particles of a diameter of 12 μm and comprises a particle thickness of 50%. The surfaces of the to-be-polished object before and after the polishing is screened and observed with a SEM device under 20 kv (kilovolt) and a magnification of 500. Hence, an obvious difference between the roughness of the surfaces of the to-be-polished object before and after the polishing is identified: the surface roughness of the to-be-polished object before the polishing 12 is 0.26 μm and that after the polishing 13 is 0.03 μm. The surface roughness of the to-be-polished object after the polishing 13 is almost as smooth as a glass, which proves that the burrs and adheres remained after a previous polishing is effectively removed by using the present invention and the surface roughness is greatly refined along with the enhanced efficiency on usage and product quality.

Figure 7:
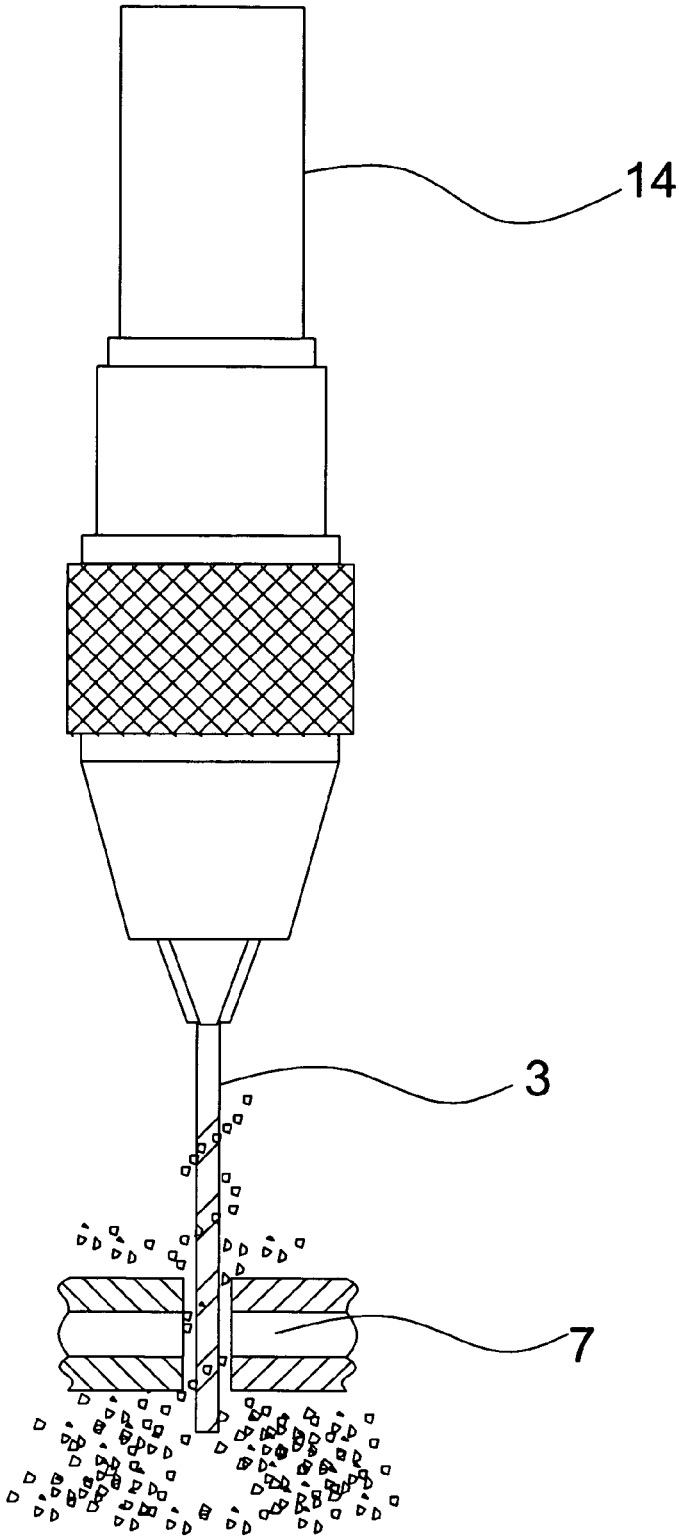
FIG. 7 is a view showing a state of use of a second preferred embodiment according to the present invention.

Please refer to FIG. 7, which is a view showing a state of use of a second preferred embodiment according to the present invention. As shown in the figure, an apparatus according to the present invention is connected with a processing station 14 to polish a to-be-polished object 7 by using a screw 3. The processing station 14 is a traditional processing machine of a driller, a miller or a lathe, or is a CNC (computer numerical control) machine.

Figure 8:
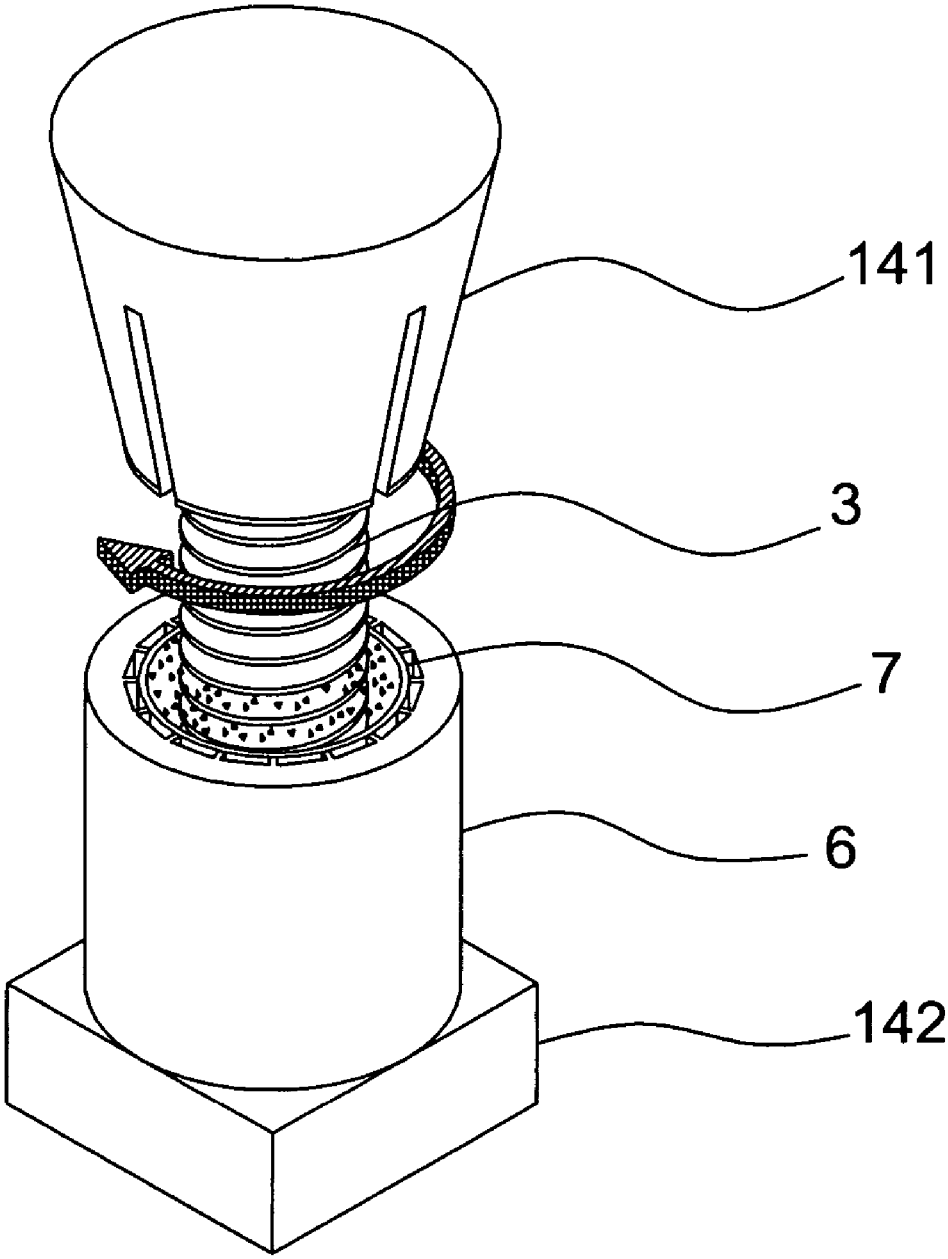
FIG. 8 is a structural view showing a third preferred embodiment according to the present invention.

Please refer to FIG. 8, which is a structural view showing a third preferred embodiment according to the present invention. As shown in the figure, an apparatus according to the present invention comprises a main shaft (not shown in the figure), a screw 3 and a main body 6. The apparatus is used for polishing a bio-medical micro channel which is processed with a micro-electrical discharge. A method for the apparatus includes the following steps: related parameters for the polishing, such as the type of an abrasive and that of the screw 3 and the rotational velocity of the screw 3, are setup; a to-be-polished object 7 is fixed within the main body 6 while the main body 6 is loaded with an abrasive and the screw 3 reaches into the main body 6; the main shaft is fixed by revolving to a revolving shaft bushing 141 of a processing station and the main body 6 is fixed on a base 142 of the processing station; and, the main shaft is driven by the processing station for doing a polish while the abrasive is carried out by the rotation of the screw 3 for refining the surface of the to-be-polished object 7 along with a reciprocating motion of the main shaft.

Figure 9:
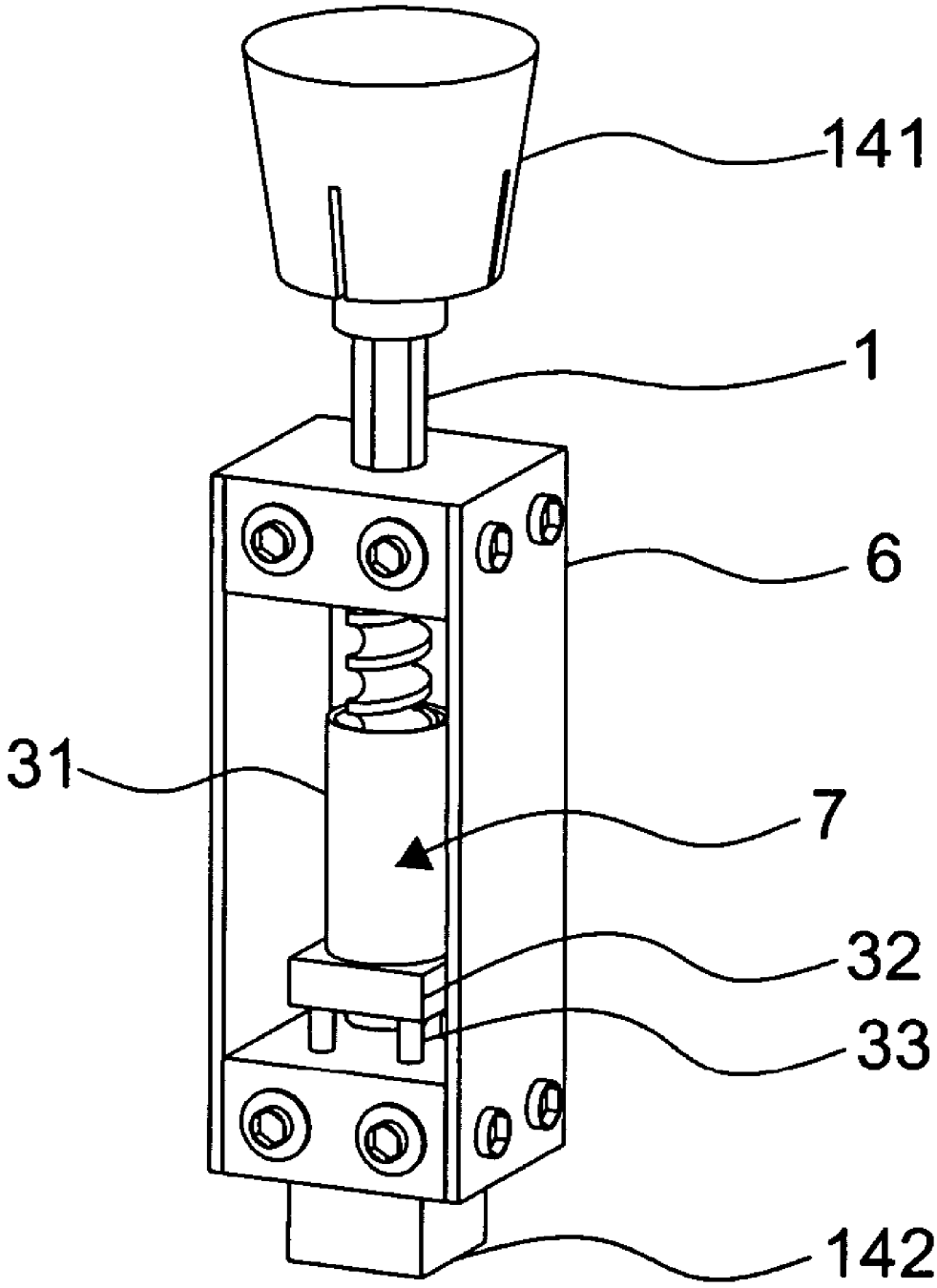
FIG. 9 is a structural view showing a fourth preferred embodiment according to the present invention.

Please refer to FIG. 9, which is a structural view showing a fourth preferred embodiment according to the present invention. As shown in the figure, an apparatus according to the present invention comprises a main shaft 1, a screw bushing 31, a screw seat 32 and a main body. The apparatus is used for polishing a guiding screw of a precise transmission device having ball bearings; or, it can be used for polishing a micro-fixing needle-pin of a bio-medical artificial joint or artificial skeleton. A method for the apparatus includes the following steps: related parameters for the polishing, such as the type of an abrasive and that of the screw 3 and the rotational velocity of the screw 3, are setup; a to-be-polished object 7 is fixed in the main body 6 while the main body 6 is loaded with an abrasive and the screw seat 32, with which the screw bushing 31 is fixed, is supported on the main body 6 by fixing shafts 33; a revolving shaft bushing 141 of a processing station is fixed by revolving to the main shaft 1 at an end while another end of the main shaft 1 is fixed with the to-be-polished object 7, and the main body 6 is fixed on a base 142 of the processing station; and, the main shaft 1 is driven by the processing station for a polishing while the abrasive is carried out by the rotation of the to-be-polished object 7 and so the surface is polished along with a reciprocating motion of the to-be-polished object 7. Therein, the to-be-polished object 7 is a bolt or a screw having thread for the polishing.

To sum up, the present invention is an apparatus for screw-polishing with abrasive and a method thereof, where surface burrs are well-removed to obtain a well-polished surface of an object.

The preferred embodiment(s) herein disclosed is/are not intended to unnecessarily limit the scope of the invention. Therefore, simple modifications or variations belonging to the equivalent of the scope of the claims and the instructions disclosed herein for a patent are all within the scope of the present invention.

What is claimed is:

1. A polishing apparatus with abrasive, comprising:

(a) a main shaft connecting to a rotating spindle of a processing station at an end of said main shaft;

(b) a screw connecting to another end of said main shaft;

(c) at least one clip to clip a to-be-polished object, said clip having a center aperture at center of said clip; and (d) an abrasive being driven by said screw to polish a surface of said to-be-polished object, together with said main shaft, said screw, said clip with said center aperture, and said abrasive, further comprising:

a cover assembling to said main shaft with a bearing;

a pressing bushing fitting to said cover by pressing with a tightening cushion between, said pressing bushing being coordinated with said clip;

at least one surrounding aperture locating around said center aperture; and a main body being loaded with said abrasive, wherein a combination of said clip and said pressing bushing is deposed in said main body;

wherein said cover is tightened to main body; and wherein said screw is locked to said main shaft with a fixing key or a bolt.

2. The apparatus according to claim 1, wherein said cover is threadedly connected to said main body.

3. The apparatus according to claim 1, wherein a plurality of said to-be-polished objects is clipped by a plurality of said clips according to space of said main body.

4. The apparatus according to claim 1, wherein a size, a shape and an arrangement of said surrounding aperture are adjusted to coordinate with said to-be-polished object.

5. The apparatus according to claim 1, wherein said tightening cushion is an O-ring.

6. The apparatus according to claim 1, wherein said bearing is selected from a group consisting of a ball bearing, a roller bearing and a needle bearing.

* * * * *